US007774966B2

(12) United States Patent
Rosa

(10) Patent No.: US 7,774,966 B2
(45) Date of Patent: Aug. 17, 2010

(54) SIGNAGE SYSTEM FOR A CARGO VEHICLE

(75) Inventor: Stephen P. Rosa, Reno, NV (US)

(73) Assignee: Night Moves, LLC, Hanover, MD (US)

( * ) Notice: Subject to any disclaimer, the term of this patent is extended or adjusted under 35 U.S.C. 154(b) by 201 days.

(21) Appl. No.: 12/175,190

(22) Filed: Jul. 17, 2008

(65) Prior Publication Data

US 2009/0019747 A1 Jan. 22, 2009

Related U.S. Application Data

(60) Provisional application No. 60/950,138, filed on Jul. 17, 2007.

(51) Int. Cl.
*G09F 21/04* (2006.01)

(52) U.S. Cl. ..... 40/590; 40/591; 40/606.15; 40/606.07

(58) Field of Classification Search ..... 40/590, 40/591, 606.07, 606.15; 116/30, 46, 51; 296/180.4, 21, 180.5, 180.1; 49/125, 61–53, 49/67

See application file for complete search history.

(56) References Cited

U.S. PATENT DOCUMENTS

| | | | | | |
|---|---|---|---|---|---|
| 2,724,917 | A | | 11/1955 | Norfleet | |
| 3,161,973 | A | * | 12/1964 | Hastings | 40/591 |
| 3,802,103 | A | | 4/1974 | Neff | |
| 4,741,569 | A | * | 5/1988 | Sutphen | 296/180.4 |
| 4,818,015 | A | * | 4/1989 | Scanlon | 296/180.1 |
| 5,355,117 | A | * | 10/1994 | Jefferson | 340/425.5 |
| 5,415,451 | A | | 5/1995 | Stanton | |
| 5,518,561 | A | | 5/1996 | Rosa | |
| 6,037,866 | A | * | 3/2000 | Leibowitz | 340/473 |
| 6,092,319 | A | | 7/2000 | Hicks | |
| 6,282,822 | B1 | | 9/2001 | Rinzler et al. | |
| 6,467,833 | B1 | * | 10/2002 | Travers | 296/180.4 |
| 6,918,200 | B2 | * | 7/2005 | Pena | 40/591 |
| 7,051,465 | B2 | | 5/2006 | Slesinski et al. | |
| 7,347,017 | B2 | * | 3/2008 | Shaffer, Jr. | 40/591 |
| 2006/0248763 | A1 | | 11/2006 | Tarabella | |
| 2007/0017132 | A1 | | 1/2007 | Curtis | |

FOREIGN PATENT DOCUMENTS

| | | | |
|---|---|---|---|
| WO | 2006015618 | A1 | 2/2006 |

* cited by examiner

*Primary Examiner*—Joanne Silbermann
*Assistant Examiner*—Christopher E Veraa
(74) *Attorney, Agent, or Firm*—Edell, Shapiro & Finnan, LLC

(57) ABSTRACT

A system for mounting signage onto the door area of a vehicle is disclosed. The system includes a mounting assembly, a display pan, and one or more inserts removably received within the display pan. The fastener assembly permits the selective reorientation of the display pan from a first position, in which the pan is oriented along the rear face of the cargo area, to a second position, in which the display pan is oriented away from the rear face of the cargo area. The inserts may include an indicia panel, a backing panel, an electroluminescent panel, and/or a support or cushioning panel. In operation, the system is mounted onto the rear facing surface of a cargo vehicle containing overhead or swing-open doors.

18 Claims, 8 Drawing Sheets

SIGNAGE SYSTEM FOR A CARGO VEHICLE

CROSS REFERENCE TO RELATED APPLICATIONS

This application is a nonprovisional application of provisional application 60/950,138, filed 17 Jul. 2007 and entitled "Advertising Display for Mounting on Vehicle Rear Door", the disclosure of which is incorporated herein by reference in its entirety.

FIELD OF THE INVENTION

The present invention relates generally to a signage system for the rear face of a delivery or cargo vehicle.

BACKGROUND OF THE INVENTION

Outdoor advertising is growing in importance as commuters spend more time on highways. The rear of cargo trailers and delivery vehicles present a challenge for wide carriage graphics because the doors must remain free to open and close in the normal conduct of business. The rear face of the cargo trailer is the location of the cargo doors. Cargo doors typically are of two types: swing-open doors and overhead doors. An exemplary swing-open door system 100 is illustrated in FIG. 1A. Swing-open door systems 100 include a door frame 110 and an opening that provides access to the cargo area. A pair of doors 120 is positioned within the opening. The doors 120 are each hinged on one vertical side (the exterior side) such that the doors open outward. The doors 120 possess roughly the same dimensions and are configured such that, when swung closed, they meet in a vertical seam along in the middle of the opening. Swing door systems may also include vertically-running locking bars 125 on the outer face of one or both of the swing doors.

FIG. 1B illustrates a typical overhead or roll-up door system 130. As illustrated, an overhead or roll-up door system 130 includes has a door frame 140 with and opening that provides access to the cargo area. A door 150 is positioned within the opening. The door 150 is formed from a series of panels 160 that are hinged together such that they "break" as they slide along a track built into the top of the cargo space. A typical overhead door is formed from multiple panels (18 to 24 inches high) that run the full width of the cargo door area. These panels are joined along the horizontal edges so that they form a semi-flexible belt that can slide up and around the bend radius of the track built into the top of the cargo compartment. Handles for lifting and closing the roll up door, and any appropriate locking hardware, is typically fastened in the middle of the bottom panel.

Attaching a seamless, large-area advertising image to either of these rear door systems is problematic. In the case of the swing door systems 100, the image will have to be fabricated and installed in at least two parts (one for each door) and, frequently, will be obscured and further striated by the vertical locking bars noted above which stand off several inches from the plane of the doors themselves. In the case of the roll up door systems 130, the advertising image must be fabricated in small segments and individually installed on each of the horizontal panels 160. Even when this installation process is precisely done, the flexible seams between each horizontal panel (necessary so that the roll up door system can function) leave noticeable seams through the advertising message.

The less-than-desirable end product, along with the inherent difficulty of installing these advertising messages properly, has limited the exploitation of the advertising potential of the rear doors on these cargo vehicles. Consequently, the wide carriage, full-color graphic images so prized by the outdoor advertising industry are virtually absent from this prime space.

Attempts have been made to address the above drawbacks. For example, one attempt stretches a semi-elastic polymer or fabric with indicia over several or all of the horizontal panels 160 in a roll-up door 150. This approach, however, does not work for swing door systems, necessitating two very different solutions for the most common door systems in use. This means that a truck fleet owner/operator managing a diverse population of vehicles has to limit any advertising campaign to only those fitted with roll-up door systems, or would have to find a second solution and then maintain two parallel advertising systems with differing spare and repair parts inventories and different graphic production and design approaches.

Additionally, the stretched fabric or polymer approach requires that the sheet materials with indicia on the outer surface be able to accommodate the repeated expansion and contraction of the seams between the break panels without any fraying, paint/ink peeling or discoloration, or creasing/sagging if the flexible substrate cannot restore to the exact dimensions prior to the stretching. The requirement for the sheet materials with indicia on the outer surface to constantly flex, stretch, and restore also makes any backlighting scheme impractical. Backlighting options such as electroluminescent (EL) panels are inelastic; consequently, an EL panel used for backlighting would not be able to stretch in proper overlay alignment with the outer sheet materials, potentially causing the backlighting to come loose and degrade the overall presentation.

Another approach utilizes two panels that are mounted to the left and right swinging doors, with the panels opening and closing with the doors. When closed, the two advertising panels would come together to form a display across the width of the doors. Spacers would hold the two advertising panels at the appropriate standoff distance from the doors themselves to accommodate and hide the vertical locking bars. This approach is suffers from significant drawbacks, since it addresses only the swing door installation and not the roll up door installations. There is no swinging door in the roll up door configuration; consequently, there is no place to attach the two advertising panels. This would again necessitate the fleet manager to maintain two separate advertising systems in order to run a fleet-wide advertising campaign.

Additionally, in order for the advertising panels to come together in a 'seamless' presentation, there can be no misalignment even after repeated heavy use. The same geometry that would provide a 'seamless' merge of the two advertising panels under ideal conditions will cause a noticeable vertical seam to appear at or close to the middle of the advertising display, degrading the presentation. Furthermore, merging two backlighting systems perfectly to form a "seamless" backlit display will be problematic given the requirement to safely insulate the edges of any illumination scheme, EL panel or otherwise. Even a slight spacing between the two backlit panels will create a detectable dark line down the middle of the display.

Thus, it would be desirable to provide a signage system operable for use on roll-up and swinging door systems that provides a seamless display and fully supports both day and night (backlit) presentations.

SUMMARY OF THE INVENTION

A system for mounting signage onto the door area of a vehicle is disclosed. The system includes a mounting assembly, a display pan, and a signage assembly. The fastener assembly permits the selective reorientation of the display pan from a first position, in which the pan is oriented along the rear face of the cargo area, to a second position, in which the display pan is oriented away from the rear face of the cargo area. The signage assembly includes one or more inserts removably received within the display pan. The inserts may include an indicia layer, a backing layer, an electroluminescent layer, and/or a support or cushioning layer. In operation, the system is mounted onto the rear facing surface of a cargo vehicle containing overhead or swing-open doors. In its deployed position, the display orients the front face of the display pan outward to display indicia to a viewer. When access to the door is required, the display pan is rotated from the deployed position to a stowed position. In the stowed position, the display pan abuts the side of the cargo vehicle (e.g., a trailer) such that the front surface of the display pan is oriented toward the vehicle.

BRIEF DESCRIPTION OF THE DRAWINGS

Like reference numerals have been used to identify like elements throughout this disclosure.

DETAILED DESCRIPTION OF THE INVENTION

Figure 1B:
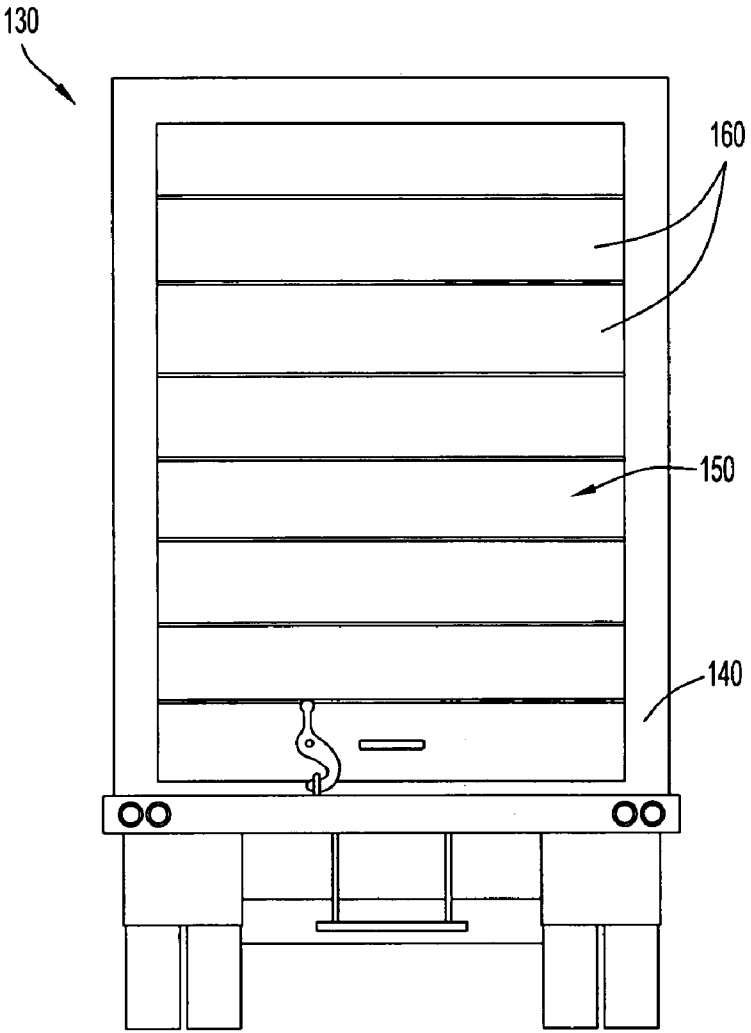
FIG. 1B illustrates a trailer having roll-up door system.
Figure 1A:
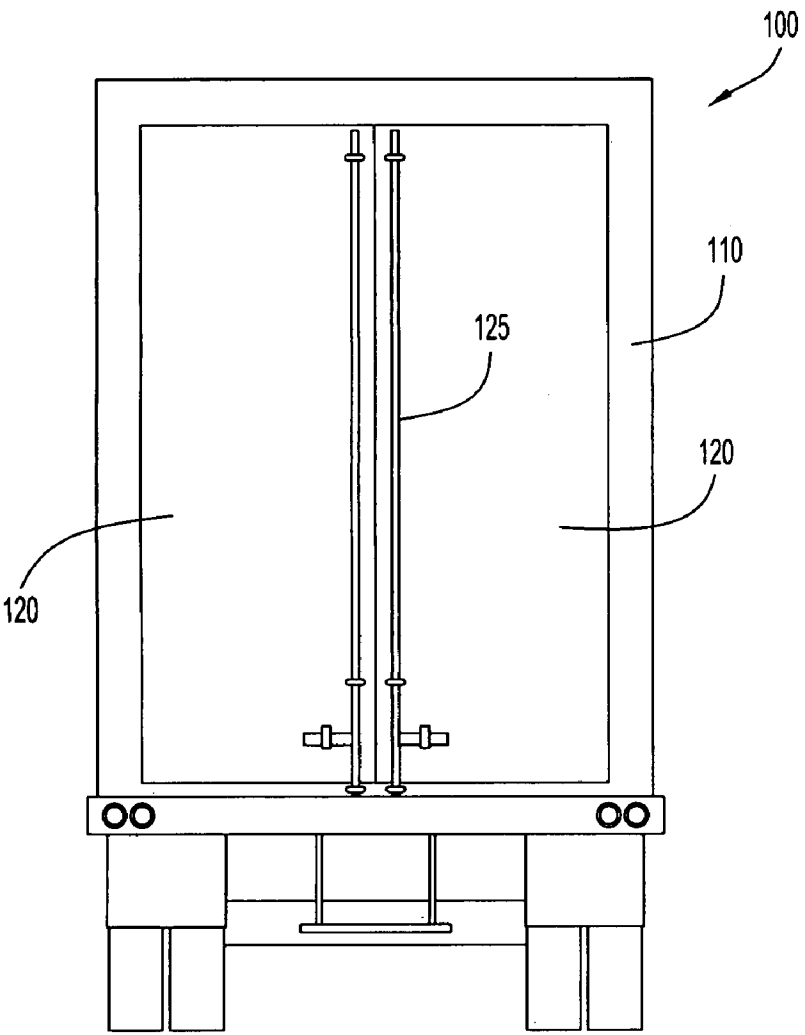
FIG. 1A illustrates a trailer having swing-open door system.
Figure 2:
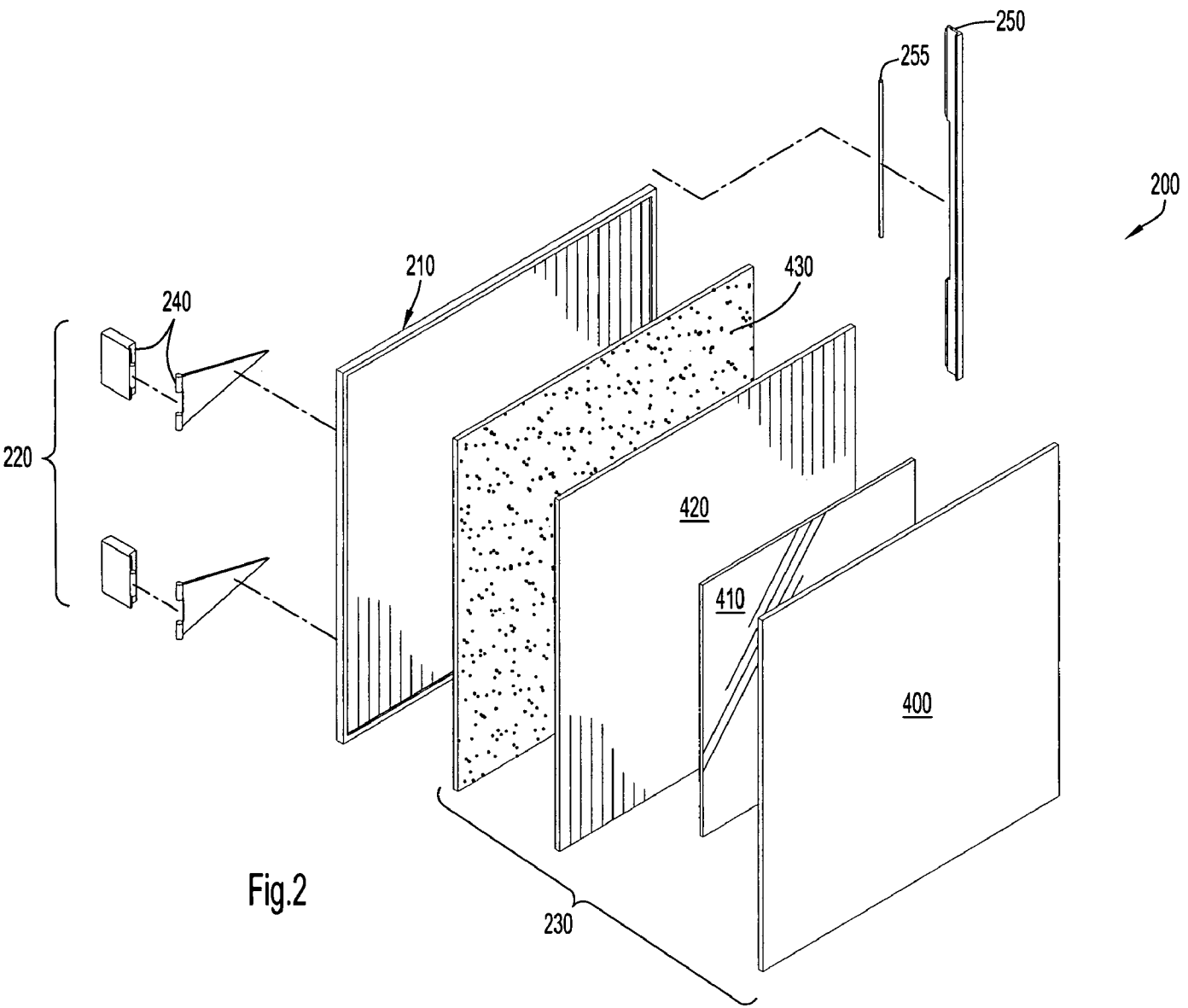
FIG. 2 illustrates an exploded view of a display system for a cargo vehicle in accordance with an embodiment of the present invention.

FIG. 2 illustrates an exploded view of the signage display system 200 in accordance with an embodiment of the invention. As shown, the system 200 includes a display pan 210, mounting assembly 220, and a signage assembly 230.

Figure 3A:
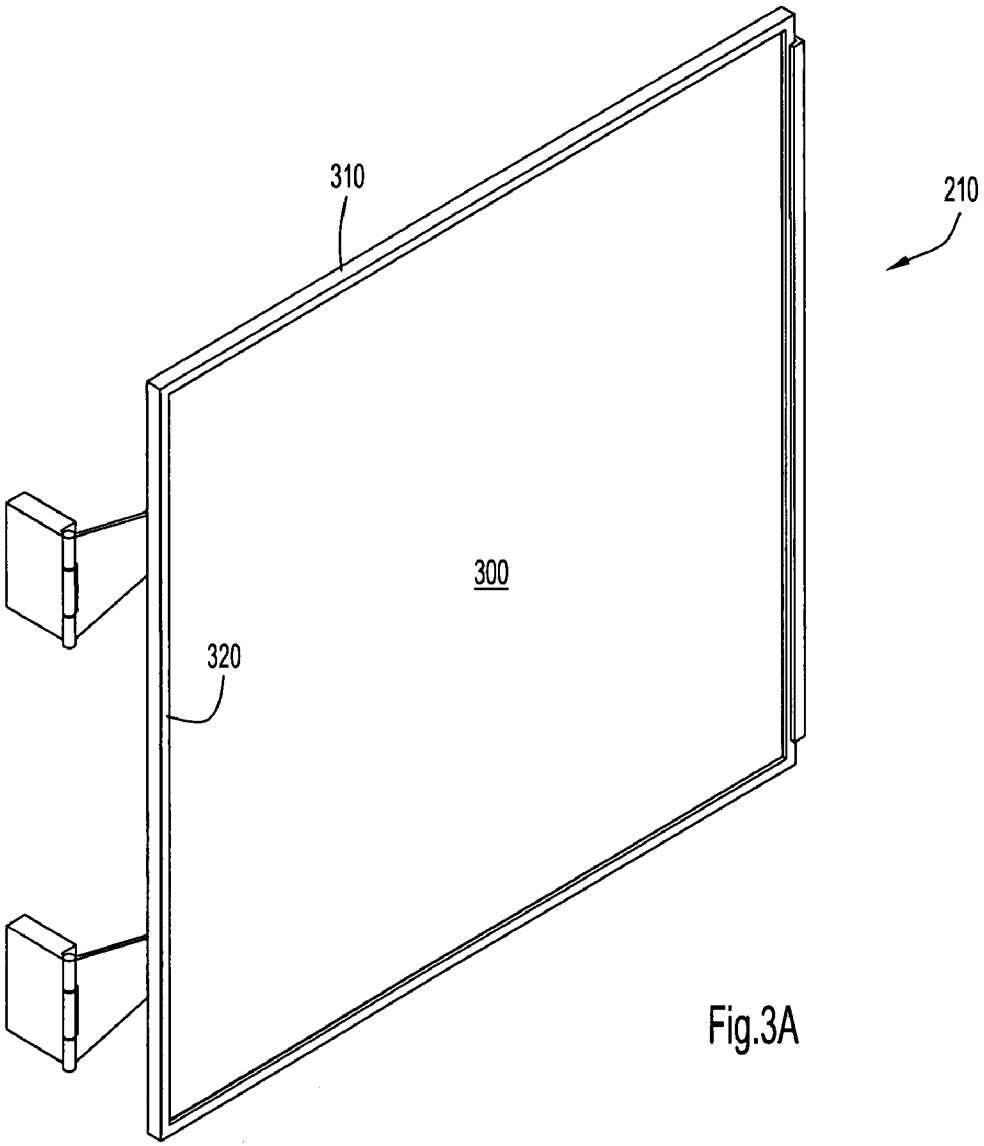
FIG. 3A illustrates a perspective, isolated view of the display pan shown in FIG. 1.

The display pan 210 is configured to support and orient the signage components forming the indicia to be displayed. FIG. 3A shows an isolated view of the display pan 210. The display pan 210 includes a base or bottom wall 300, and a side wall 310 extending upward from the perimeter of the base wall. The display pan 210 further includes a lip or border 320 extending inward such that it is oriented generally transverse to the side wall 310 (and generally parallel to the base wall 300). The lip 320 defines the front face of the display pan. The base wall 300, side walls 310, and border 320 form a cavity with generally U-shaped channel that receives the signage assembly, securing the components of the assembly for display.

The base wall 300 of the display pan 210 is preferably solid in order to prevent turbulent air flow from pushing on the signage components positioned within the display pan. The base wall 300 and/or sidewalls 310 may include reinforcing features such as corrugations, diagonal ribs, or other features to enhance the durability and structural strength of the display pan 210. In addition, slatted or other open designs are possible for the rear of the pan to reduce the overall weight of the display pan 210. For example, when the display pan 210 is generally square/rectangular (as shown in the embodiment of FIG. 3A), the side walls 310 form a top horizontal side/edge, a bottom horizontal side/edge, and left and right vertical sides/edges.

As noted above, the display pan 210 defines a cavity that receives the signage assembly 230, capturing the components of the assembly within the cavity and orienting the components for display. To enable the removal of the signage assembly 230 from and the insertion of the signage assembly 230 into the display pan 210, the display pan may be adapted to open. By way of example, a portion of the side wall 310 may be provided with an aperture that permits the passage of the signage assembly 230 (or one of its components) therethrough. By way of further example, a portion of the side wall 310 may be provided with a pivoting door that may be selectively opened to permit axis to the cavity of the display pan. By way of yet another example, a portion of the side wall 310 may be formed by a removable cap releasable fastened to the display pan 210 (via friction fit, screws, clamps, etc). The opening, door, or cap may be provided along a vertical edge of the display pan 210. In operation, users can selectively insert and remove advertising presentation without use of special tools or any assembly/disassembly.

The display pan 210 may further be adapted to selectively mate with a latch disposed at a predetermined positioned on the vehicle. By way of example, a rib may protrude from the display pan 210, running along the vertical edge of the pan opposite the hinge connection. In operation, the rib selectively mates with a latch disposed along the rear surface of the cargo vehicle (on the door frame 110, 140), as well as a fastener disposed along the side of the cargo vehicle (discussed in greater detail below).

The display pan 210 may further accommodate an electrical connection. For example, the display pan 210 may include a fitting suitable for electrical power and control wiring to the inside of the display pan that supports the use of an electrical device such as an electrically powered backlighting system. The power and control wiring may include standard connectors for "plug and view" operation of backlit advertising, and may also feature secure strain-relieved interfaces at the vertical side of the pan next to the hinges and/or in the hinges themselves.

The display pan 210 may possess any dimensions suitable for its intended purpose. By way of example, the length of the display pan 210 may be sized to correlate to the width of the cargo door in such a manner that the display pan does not cover, obscure, block the viewing of, or otherwise detract from the tail lights, back up lights, markings, or other safety devices fitted to the delivery truck or cargo trailer. By way of further example, the display pan 210 may possess a depth (thickness) of up to about two (2) inches. This depth prevents the display pan 210 from obstructing movement around the vehicle in either the deployed or stowed positions.

In addition, the display pan 210 may include any shape suitable for its intended purpose. In its simplest configuration, the display pan 210 possesses a generally rectangular shape sized to span across the cargo doorway. The display pan 210, however, can be a regular or irregular shape to hold specially shaped logos and other promotional images. The materials forming the display pan 210 may include, but are not limited to, metal (e.g., stainless steel, galvanized steel, and aluminum), fiberglass or other composites, and plastic.

Figures 3B, 3C:
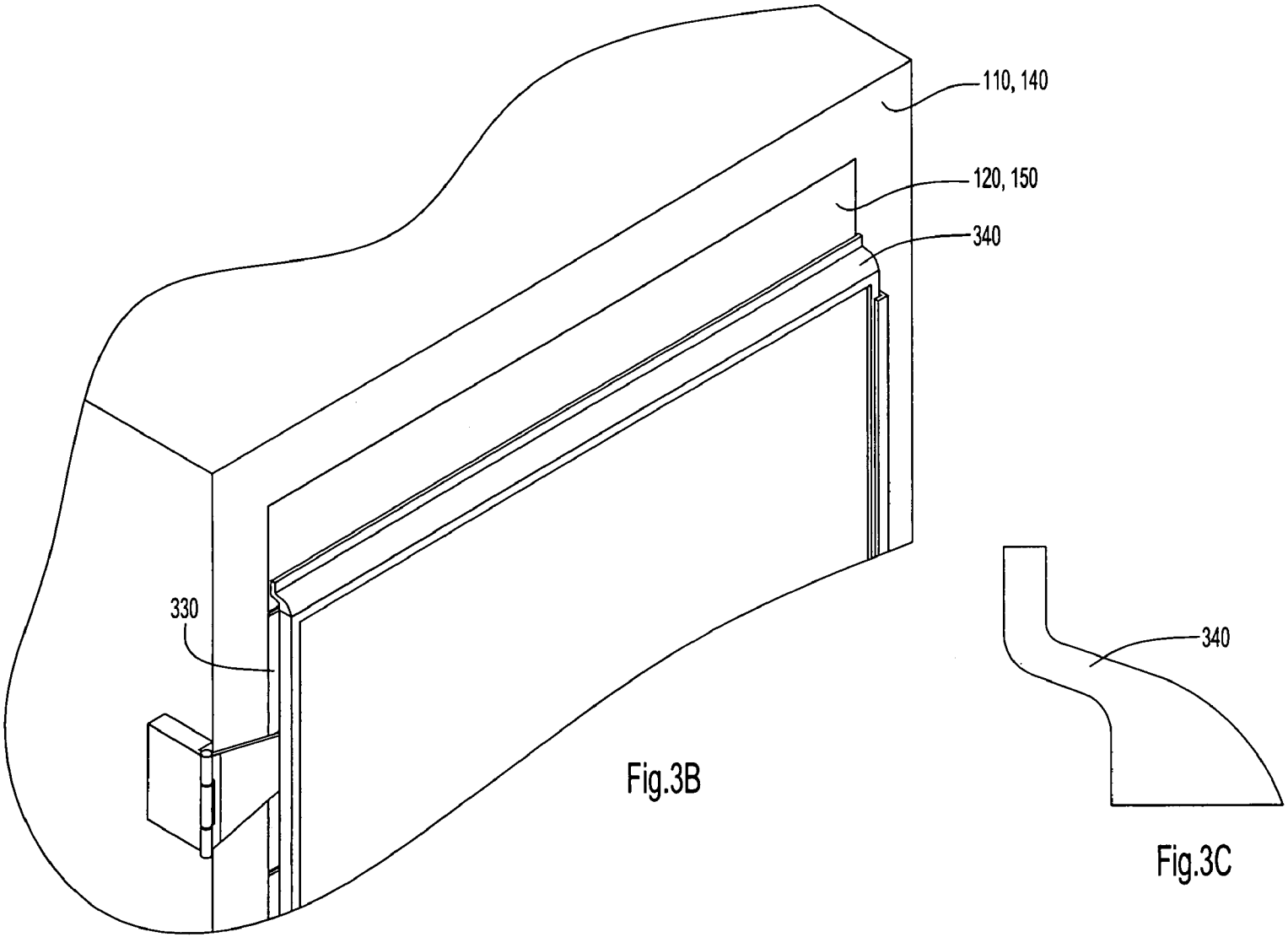
FIG. 3B illustrates a display pan in accordance with an embodiment of the invention, showing the display pan mounted onto a trailer.
FIG. 3C illustrates a side view of the astragal shown in FIG. 3B.

FIG. 3B illustrates a display pan 210 in accordance with another embodiment of the invention, further including a fluid deflector. The system 200, when mounted onto a vehicle, includes a clearance gap 330 between the bottom surface of the base wall 200 and the exterior surface of the vehicle door 120, 150. When the cargo vehicle is in motion, air flows over the top and sides of a cargo trailer, wrapping turbulently around the rear face of the trailer and into the clearance gap 330 between the display pan 210 and the door 120, 150. The airflow continually exerts inward and outward forces on the display pan 210, vibrating the pan and the mounting assembly 220. This, in turn, can cause the display pan 210 to come loose. In addition, this creates a significant level of drag, which negatively impacts the cargo vehicle's fuel efficiency.

Thus, a fluid deflector 340 is provided to seal the clearance gap 330 between the display pan 210 and the vehicle door, as well to direct the flow of fluid (air and water) over the exterior surface of the display pan 210. The fluid deflector 340 may be in the form of a flexible barrier or rigid molding. As shown in FIG. 3B, the fluid deflector 340 is in the form of an astragal disposed along the upper edge of the display pan 210 (i.e., the top portion of the side wall 310). The astragal may be formed from materials such as plastic, rubber, etc. Alternatively or in addition to, the astragal may be formed from the same or different material forming the display pan 210. The astragal may be made integral with the display pan 210, or may be a separate component secured thereto. As seen in FIG. 13C, the fluid deflector may be angled, sloping away from the door 120, 150 and toward the display pan 210.

The fluid deflector 340 may be disposed along only top edge of the display pan 210. Alternatively or in addition to, the fluid deflector 340 may be disposed along a plurality of the edge and/or bottom portions of the side wall 310. In operation, the fluid deflector 340 prevents turbulent air from getting behind the display pan 210, as well as prevents wind shear forces from disturbing the display pan. In addition, since the fluid deflector 340 seals the clearance gap 330, water is prevented from entering the gap 330, protecting the base wall 300 of the display pan 210 from excessive moisture.

As noted above, trucks and cargo containers may include vertical locking bars. To accommodate such bars, the fluid deflector 340 may be notched in the appropriate locations to fit over the bars. Trucks/trailers with swing-out doors may further include one, two, or four vertical locking bar configurations, typically in a predetermined pattern and location. Each of these can be addressed with the appropriate number of pre-cut indexes cut into the fluid deflector, the remaining portion of the astragal coming into direct contact with the door outer surface to create a substantially fluid-tight seal.

The mounting assembly 220 is configured to secure the display pan 210 to a cargo vehicle in display and stowed orientations. Referring to FIGS. 2 and 5, the mounting assembly 220 may include one or more pivot joints 240, a first or rear latch 250, and a second or side latch 260. The pivot joints 240 pivotally couple the display pan 210 to the cargo vehicle. By way of example, the pivot joints 240 may include hinges coupled to the door frame 110, 140 that are configured to permit the rotation of the display pan 210 about a generally vertical axis. The degree of rotation may include, but is not limited to, at least about 270°.

The latches 250, 260 selectively secure the display pan 210 in its stowed and deployed positions. In the illustrated embodiment, the latches 250, 260 are in the form of a bracket operable to capture an edge of the display pan, securing it to the cargo vehicle. In the illustrated embodiment, the rear latch 250 is a bracket mounted to a vertical edge of the door frame 110, 140 (opposite the pivot joints 240). The side latch 260, moreover, is a bracket disposed along the side of the trailer 500 (FIG. 5). The brackets may be C-shaped or L-shaped, defining a channel sized to receive the pan. The brackets 250, 260, moreover, are hinged (via pivot bar 255) such that the each bracket rotates away/toward the display pan 210 to selectively capture and release the pan. In other words, the brackets 250, 260 capture the vertical edge of the display pan 210, securing it to the cargo vehicle. As noted above, the display pan 210 may further include a rib that engages the brackets to provide further security to latching of the display pan.

To release the display pan 210, the bracket 250, 260 is pivoted away from the display pan until the bracket clears the pan. In operation, the first latch 250 secures the display pan 210 in its first, display position, while the second latch 260 secures the display pan 210 in its second, stowed position (discussed in greater detail, below). With the above described configuration, an operator can selectively swing the display pan away from and back generally flush to the cargo compartment during loading and unloading operations.

The mounting assembly 220 may further include any conventional locks and/or security devices to prevent theft of the display pan 210 and/or the advertising indicia, as well as to make it more difficult for unauthorized access to the cargo compartment itself. Fitting the latches 250, 260 with locks or another suitable secure closure, furthermore, reduces the potential for the display pan 210 to swing open while the vehicle is moving.

In another embodiment, the pivot joints 240 may be configured to permit the selective dismounting of the display pan 210 from the joints. That is the display pan may be selectively separated from the pivot joints 240 to enables an operator to completely remove the display pan 210 while leaving the mounting assembly intact. In still another embodiment, the mounting assembly 220 may be in the form of parallel mounting brackets secured to the door frame 110, 140 at predetermined locations. The display pan 210 includes complementary arms (e.g., L-shaped arms) that slide into the parallel mounting brackets. This facilitates the complete removal and replacement of the display pan 210 and, as such, the replacement of one advertising presentation for another.

Figure 4:
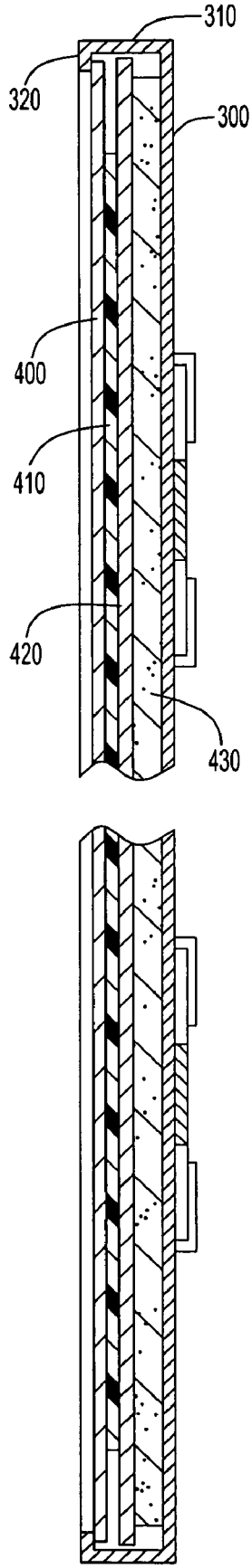
FIG. 4 illustrates cross sectional view of the device of FIG. 1, showing the display pan and selected panel inserts.

The signage assembly 230 presents indicia to a viewer, orienting the indicia outward such that, when the display pan is in its deployed position, it is visible by a viewer. Referring to FIG. 4, the signage assembly 230 may include one or more of an indicia layer 400, an optional illumination/backlighting layer or panel 410, a backing layer or panel 420, and/or a support (packing) layer or panel 430. The indicia layer 400 may be in the form of a self supporting panel (e.g., a transparent substrate with graphics thereon), or may be a layer of printing applied to directly the illumination layer 410 or the backing layer 420. The backing layer 420 includes rigid or semi-rigid substrates to which the indicia layer 400 (advertising graphics or other indicia) may be applied (via bonding, etc.), or to which the backlighting panel 410 is mounted. The backing layer 420 also includes flexible substrates to which the indicia layer 400 (advertising graphics or other indicia) may be applied (e.g., via painting or printing), or to which the backlighting panel 410 may be mounted. For example, the backing layer 420 may be formed from a sheet of corrugated plastic sold under the trade name COROPLAST (available from Coroplast, Dallas, Tex.).

The illumination panel 410 includes a thin-film backlighting system inserted between the backing layer 420 and the indicia layer 400. By way of specific example, the backlighting panel 420 may be an electroluminescent (EL) thin film panel.

The support layer 430 is operable to position the indicia panel 410 toward the outward edge of the display pan 210 (against the border 320), as well as to absorb shocks and vibration that occur while the vehicle is in motion. For example, the material forming the support layer 430 may include a foam layer that holds the indicia layer against the border 320 of the display pan 210.

Figure 5A:
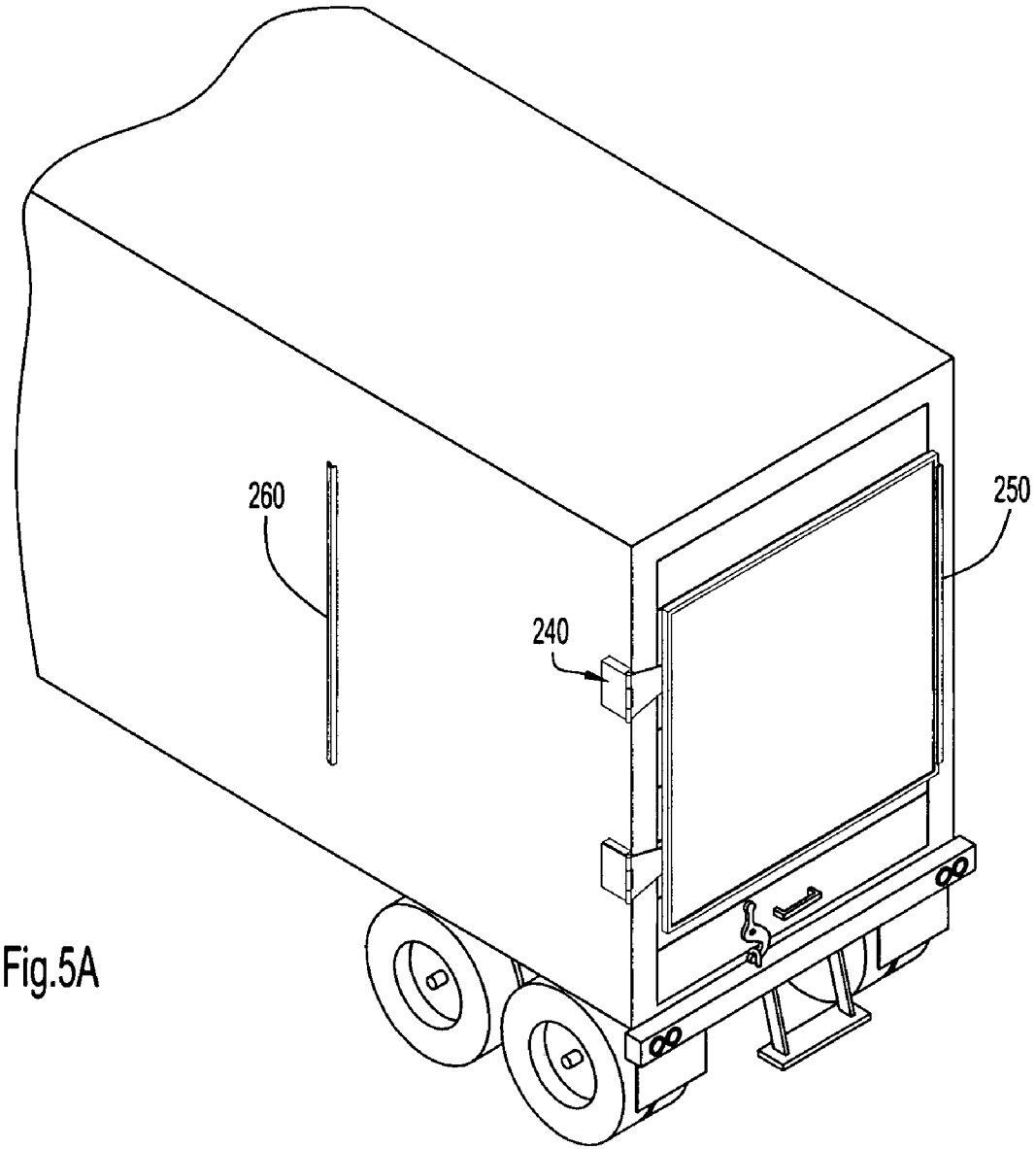
FIG. 5A illustrates a perspective view of a cargo vehicle including the system of FIG. 1 mounted thereto and oriented in a first, display position.
Figure 5B:
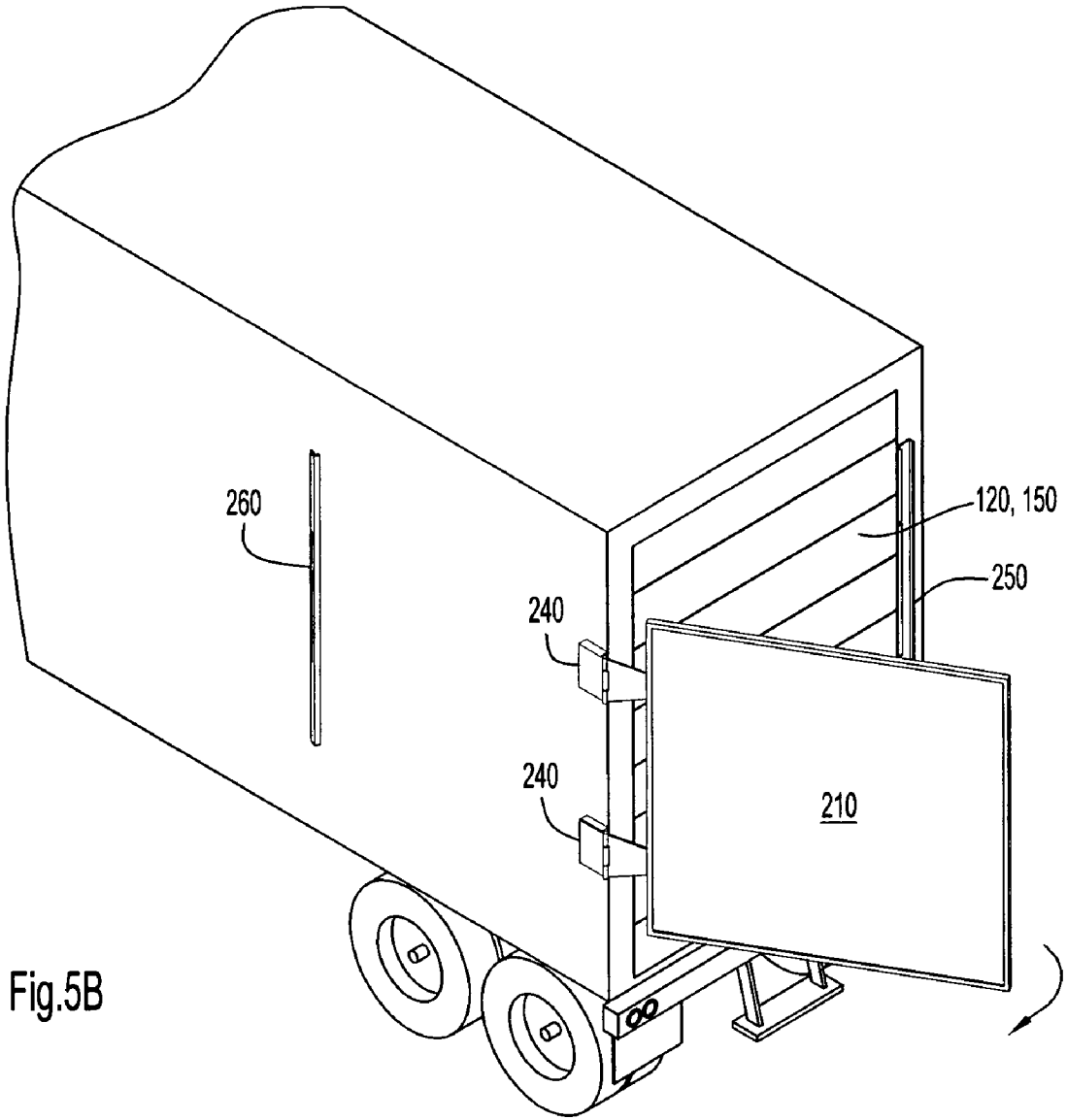
FIG. 5B illustrates the system of FIG. 5A moving from the first position to a second position.

The operation of the device is explained with reference to FIGS. 5A, 5B, and 5C. Referring to FIG. 5A, the display pan 210 begins in its display or deployed position. In the deployed position, the display pan 210 is attached to the frame 110, 140 of a cargo compartment 500 such that the front face of the display pan faces outward. The display pan 210 is held generally flush to the face of the cargo door 120, 150, with the advertising indicia exposed for viewing. Thus, the indicia layer 400 faces outward (away from the trailer), being readily visible to a viewer.

To reorient the display pan 210, the operator releases the rear latch 250 and rotates the display pan 210 along the pivot joints 240 (indicated by arrow), both as described above.

Figure 5C:
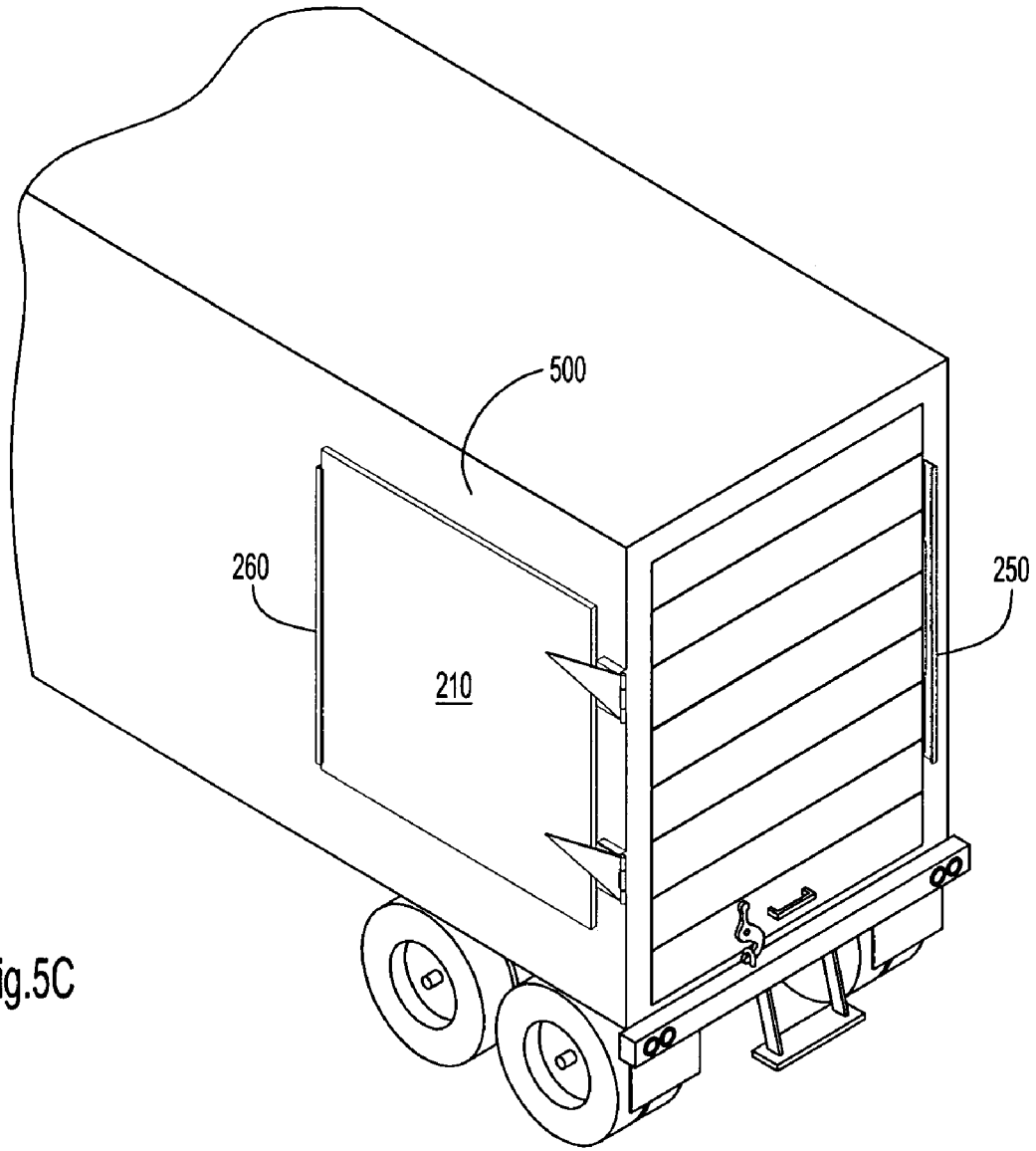
FIG. 5C illustrates the system of FIG. 5A, showing the system oriented in its second, stowed position.

Referring to FIG. 5C, the display pan 210 is rotated through a full 270° arc to expose the cargo doors 120, 150 for loading and unloading of the cargo. When fully rotated through the 270° arc, the pivot joints 240 orient the display pan 210 generally flush against the side of the cargo compartment 500. The side latch 260 is first rotated forward (toward the front of the vehicle) and then back again to capture the vertical edge of the display pan 210, securing it in its stowed position. In the stowed orientation, the front face of the display pan 210 now faces inward, toward the cargo compartment 500. Thus, the indicia layer 400 faces the compartment 500 and is not visible to viewer. Thus, the indicia layer 400 is protected during the loading/unloading of the vehicle. The stowed orientation also permits the vehicle to be positioned in close proximity to other vehicles, structures, and features that may be encountered in the normal course of business.

This above-described mounting assembly 220 provides a signage system with a modular design, wherein the pivot joints 240 and the latches 250, 260 may be standardized for an entire fleet of vehicles.

While the present invention has been described in detail and with reference to specific embodiments thereof, it will be apparent to one skilled in the art that various changes and modifications can be made therein without departing from the spirit and scope thereof. For example, the display pans 210 can be fabricated in a variety of shapes and dimensions to accommodate all of the various delivery truck and cargo trailer designs. This includes trucks with cargo compartments fitted with heavy duty fabric walls, trucks with fold-down ramps, and other special or unique features. The display pan 210 may be adapted to display indicia on both its front and rear faces, thus enabling one type of advertisement to be visible when the display pan is in the deployed position, and another advertisement to be visible when the display pan is in its stowed position. For example, a logo may be applied directly to the outer surface of the base wall 300. Alternatively, an indicia layer may be mounted to the outer surface of the base wall 300.

The signage assembly 230 may include additional components such as transparent protective layers, additional light sources (other than the backlighting panel), etc. In addition, the display pan 210 may be designed to hold a flexible substrate tensioning system such that advertising presentations printed on fabrics or plastic sheets can be used. The signage assembly may include graphics displays such as that shown in U.S. Pat. No. 5,518,561 (Rosa), the disclosure of which are hereby incorporated by reference in its entirety. Briefly, the graphics display panel includes a flexible planar electroluminescent lamp; a translucent image-carrying film substrate capable of producing spectrally similar images with front and back illumination; and an optically clear flexible adhesive to adhere the image-carrying substrate to the lamp; and a protective layer of weather and wear resistant essentially transparent material. The electroluminescent lamp is a thin conformable sandwich construction including a layer of electroluminescent material bonded between an opaque electrode layer on the opaque side and an essentially transparent electrode layer on the light-emitting side.

The mounting assembly 220 and/or display pan 210 may further include a sensor operable to signal to inform the driver/operator of the vehicle that the pan is not securely held in place.

The fluid deflector 340 may be of and size and shape and be formed of any suitable material. Preferably the fluid deflector 340 is formed from material providing a flexible, substantially fluid-tight seal between the edge of the display pan 210 and the outer surface of the cargo door 120, 150 when the display pan is positioned in the deployed and latched/locked position across the cargo door.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

I claim:

1. A display assembly for a vehicle including a cargo compartment having a side wall and an access door supported by a door frame, the display assembly comprising:

a display pan having a first lateral edge and a second lateral edge, the display pan including:

a base wall, a side wall extending distally from the base wall, the side wall having a proximal end and a distal end, and a flange extending from the distal end of the side wall, wherein the flange defines a front border of the display pan;

a mounting assembly including:

a first latch mountable to the door frame, wherein the first latch selectively captures the first lateral edge of the display pan, a second latch mountable to the side wall of the cargo compartment, wherein the second latch selectively captures the first lateral edge of the display pan, and a pivot joint coupled to the second lateral edge of the display pan, wherein the pivot joint pivotally mounts the display pan to the cargo compartment; and a signage assembly housed within the display pan, the signage assembly including a layer with indicia, wherein the display pan is selectively reconfigurable from a deployed position, in which the display pan is positioned over the doors of the cargo compartment such that the front border faces outward, to a stowed position, in which the display pan is positioned away from the doors to provide access to the cargo compartment, and wherein, in the stowed position, the display pan is oriented such that the front border faces the side wall of the cargo compartment.

2. The display assembly of claim 1, wherein:

in the deployed position, the indicia is visible to a viewer of the display pan mounted on the cargo compartment; and in the stowed position, the indicia is not visible to a viewer of the display pan mounted on the cargo compartment.

3. The display assembly of claim 1, wherein:

the display pan defines a cavity configured to receive the signage assembly; and the display pan is configured to permit the selective removal of the signage assembly from the cavity while the display pan is mounted on the vehicle.

4. The display assembly of claim 1, wherein the first latch comprises an L-shaped bracket pivotally coupled to the door frame.

5. The display assembly of claim 1, wherein the signage assembly comprises:

the indicia layer;

a backing layer; and a backlighting layer operable to illuminate the indicia, wherein the backlighting layer is disposed between the indicia layer and the backing layer.

6. The display assembly of claim 5, wherein the backlighting layer comprises an electroluminescent panel.

7. The display assembly of claim 5, wherein:

the signage assembly further comprises a support layer in contact with an interior surface of the base wall of the display pan; and the support layer supports the indicia layer within the display pan.

8. The display assembly of claim 1 further comprising a fluid deflector disposed along an edge of the display pan, wherein the fluid deflector is operable to direct air over a front surface of the display pan.

9. The display assembly of claim 8, wherein:

the display pan possesses a generally rectangular shape having a top edge, a bottom edge, the first lateral edge and the second lateral edge;

the first and second edges define vertical edges of the display pan; and the fluid deflector comprises an astragal disposed along an the top edge of the display pan.

10. The display assembly of claim 8, wherein, in the deployed position, the fluid deflector angularly extends from the edge of the display pan to an exterior surface of the vehicle door.

11. The display assembly of claim 1, wherein:

the pivot joint enables rotation about a generally vertical axis; and the pivot joint permits the rotation of the display pan along a generally 270° arc.

12. A reconfigurable advertising display system for a vehicle comprising:

a vehicle including a cargo compartment having a side wall and an access door supported by a door frame;

a display assembly comprising:

a display pan mounted to the cargo compartment of the vehicle, the display pan including:

a base wall, a side wall extending distally from the base wall, the side wall defining a first lateral edge and a second lateral edge, and a flange extending from a distal end of the side wall, wherein the flange defines a front border of the display pan;

a mounting assembly including:

a first latch coupled to the door frame of the cargo compartment, wherein the first latch selectively captures the first lateral edge of the display pan, a second latch coupled to the side wall of the cargo compartment, wherein the second latch selectively captures the first lateral edge of the display pan, and a pivot joint coupled to the second lateral edge of the display pan, wherein the joint pivotally mounts the display pan to the cargo compartment; and a signage assembly housed within the display pan, the signage assembly including a layer with indicia, wherein the display pan is selectively reconfigurable from a deployed position, in which the display pan is positioned over the access door of the cargo compartment such that the front border faces outward, to a stowed position, in which the display pan is positioned away from the access door to permit access to the cargo compartment, and wherein, in the stowed position, the display pan is oriented such that the front border faces the side wall of the cargo compartment.

13. The reconfigurable advertising display system of claim 12, wherein:

in the deployed position, the indicia is visible to a viewer of the display pan mounted on the cargo compartment; and in the stowed position, the indicia is not visible to a viewer of the display pan mounted on the cargo compartment.

14. The reconfigurable advertising display system of claim 12, wherein:

the first latch comprises an L-shaped bracket pivotally coupled to the door frame; and the second latch comprises an L-shaped bracket pivotally coupled to the side wall of the cargo compartment.

15. The reconfigurable advertising display system of claim 12, wherein the signage assembly comprises:

the indicia layer;

a backing layer; and a backlighting layer operable to illuminate the indicia, wherein the backlighting layer is disposed between the indicia layer and the backing layer.

16. The reconfigurable advertising display system of claim 12 further comprising a fluid deflector disposed along an edge of the display pan, wherein the fluid deflector is operable to direct air over a front surface of the display pan.

17. A method of selectively displaying indicia on a vehicle including a cargo compartment having an access door supported by a door frame, the method comprising:

(a) providing a display assembly for a vehicle including a cargo compartment having an access door supported by a door frame, the display assembly comprising:

a display pan having a first lateral edge and a second lateral edge and including:

a base wall, a side wall extending distally from the base wall, the side wall having a proximal end and a distal end, and a flange extending from the distal end of the side wall, wherein the flange defines a front border of the display pan;

a mounting assembly including:

a first latch mountable to the door frame, wherein the first latch selectively captures the first lateral edge of the display pan, a second latch mountable to the side wall of the cargo compartment, wherein the second latch selectively captures the first lateral edge of the display pan, and a pivot joint coupled to the second lateral edge of the display pan, wherein the pivot joint pivotally mounts the display pan to the cargo compartment; and (b) positioning a signage assembly within the display pan, wherein the signage assembly includes an indicia layer;

(c) orienting the display pan in a deployed position, in which the indicia layer faces away from the cargo compartment such that the indicia is visible to a viewer of the display panel; and (d) reorienting the display pan from the deployed position to a stowed position, in which the indicia faces toward the cargo compartment such that the indicia is not visible to a viewer of the display pan.

18. The method of claim 17, wherein (d) comprises (d.1) rotating the display pan approximately 270° about the pivot joint to reorient the display pan from the display position to the stowed position.

* * * * *